US006298290B1

(12) United States Patent
Abe et al.

(10) Patent No.: US 6,298,290 B1
(45) Date of Patent: Oct. 2, 2001

(54) MEMORY APPARATUS FOR VEHICLE INFORMATION DATA

(75) Inventors: Takeshi Abe; Tadashi Ezura, both of Tokyo (JP)

(73) Assignee: Niles Parts Co., Ltd., Tokyo (JP)

( * ) Notice: Subject to any disclaimer, the term of this patent is extended or adjusted under 35 U.S.C. 154(b) by 0 days.

(21) Appl. No.: 09/476,788

(22) Filed: Dec. 30, 1999

(51) Int. Cl.[7] ..... G07C 5/08
(52) U.S. Cl. ..... 701/35; 701/45; 340/937
(58) Field of Search ..... 701/35, 45; 369/21; 340/937; 348/148, 149

(56) References Cited

U.S. PATENT DOCUMENTS

| | | | | |
|---|---|---|---|---|
| 4,638,289 | * | 1/1987 | Zottnik | 246/45 |
| 4,789,904 | * | 12/1988 | Peterson | 386/1 |
| 5,497,419 | * | 3/1996 | Hill | 380/9 |
| 5,638,273 | * | 6/1997 | Coiner et al. | 701/35 |
| 5,815,093 | * | 9/1998 | Kikinis | 340/937 |
| 5,948,026 | * | 9/1999 | Beemer, II et al. | 701/35 |
| 5,978,017 | * | 11/1999 | Tino | 348/148 |
| 6,067,488 | * | 5/2000 | Tano | 701/35 |
| 6,073,063 | * | 6/2000 | Leong Ong et al. | 701/35 |
| 6,076,028 | * | 6/2000 | Donnelly et al. | 701/45 |
| 6,141,611 | * | 10/2000 | Mackey et al. | 701/35 |

FOREIGN PATENT DOCUMENTS

| | | | |
|---|---|---|---|
| 19827622A | | 12/1999 | (DE) . |
| 0947963A1 | * | 6/1999 | (EP) . |
| 09042977A | * | 2/1997 | (JP) . |
| 09198858A | * | 7/1997 | (JP) . |
| 09272399A | * | 10/1997 | (JP) . |
| 10310088A | * | 11/1998 | (JP) . |
| 8809023 | * | 11/1988 | (WO) . |

* cited by examiner

*Primary Examiner*—Michael J. Zanelli
*Assistant Examiner*—Eric M Gibson
(74) *Attorney, Agent, or Firm*—Ronald P. Kananen; Rader, Fishman & Grauer

(57) ABSTRACT

A memory apparatus for vehicle information is provided in which the image data of the vehicle's condition in a traffic accident, a traffic offense, a drive condition from the occurrence of an accident to the vehicle's stop after the accident, and a sensor data are memorized and held in a flash memory repeatedly. The memory apparatus enables an analysis of an accident with high precision upon the reproduction of the data of the vehicle's condition, and can be used to provide evidence relating to a traffic offense. The image signals from a CCD camera 1, a RAM 12 for memorizing the sensor's information from a vehicle speed sensor 3, a steering angle sensor 4, a brake pressure sensor 5, and an acceleration sensor 6, and a flash memory 13 for permanently memorizing the signals of the RAM 12, are controlled through a CPU 11. The record information of the RAM 12 is transferred to the flash memory 13 based on the operation of a collision sensor 2 to memorize and hold the information. Moreover, the signal of the flash memory 116 is converted into a video signal to output the information during a reproduction.

15 Claims, 11 Drawing Sheets

MEMORY APPARATUS FOR VEHICLE INFORMATION DATA

BACKGROUND OF THE INVENTION

1. Field of the Invention

The present invention relates to a memory apparatus for vehicle information data in which the image data representing an ambient drive condition, obtained by an imaging device such as CCD camera, and the data representing a vehicle drive condition obtained from several sensors are memorized in a memory element, thereby enabling a precise analysis of the cause of a traffic accident and a precise inspection of corroborative data regarding the vehicle's conditions before and after a traffic accident, or a traffic control condition.

2. Description of the Related Art

A conventional recording method for recording a vehicle's condition immediately before an accident includes providing several sensors for sensing a vehicle's speed, a steering angle, a brake pressure, an acceleration and the like of the vehicle, to enable an analysis of the cause of the vehicle's accident.

However, according to the conventional method, the information from the several sensors is merely recorded. Therefore, it is difficult to clearly recognize an accident generation condition, thereby resulting in an insufficient analysis of the cause of the accident.

SUMMARY OF THE INVENTION

An object of the present invention is to solve the problems with the conventional recording method described above, and to provide a memory apparatus for vehicle information data in which there are recorded not only the information of sensors, such as a vehicle speed, but also the image information immediately before an accident, thereby suitably recognizing the accident generation condition and enabling a smooth and accurate analysis of the accident.

A further object of the present invention is to provide a memory apparatus for vehicle information data to facilitate the inspection of the cause of an accident after the accident.

A still further object of the present invention is to provide a memory apparatus with memory inhibiting means for continuing the recording of a vehicle's accident until a predetermined condition after the vehicle's accident, releasing means for releasing the memory inhibition, and a function switch for enabling selective recording other than an accident.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

According to a broad aspect of the present invention, a memory apparatus for vehicle information data is provided, comprising: imaging means for imaging a vehicle's condition during a running state, drive information sensing means for sensing the drive information, such as a vehicle's speed, a steering angle, a brake pressure, and an acceleration during the running state, recording means for recording the image information from the imaging means and the drive information sensing means simultaneously, sensors for detecting predetermined conditions, and record information storing means for storing the recorded information of the recording means according to the predetermined conditions detected by the sensors.

The imaging means includes a camera in the vehicle for imaging the drive condition of the inside of the vehicle. The record information storing means has a flash memory, inhibits the information recording in the recording means, and transfers the newest record information to the flash memory. The recording means deletes the oldest information and records the newest information. An image compression section is provided for compressing the image information to record, and an encoder is provided for processing the record information from the flash memory. The recording means includes a video recorder. The sensors include a collision sensor for detecting an occurrence of traffic accidents.

The memory apparatus further includes a function switch for switching a memory processing means of the vehicle's information data, a plurality of imaging devices for imaging an ambient drive state, and a RAM for memorizing the image signals from the imaging devices. A CPU is provided for effecting a sequential memory processing of the signals on the basis of the vehicle drive information transmitted from the sensors to memorize them at the RAM and a flash memory.

The memory apparatus further includes a function switch for switching a memory processing means of the vehicle's information data, and a CPU for feeding and controlling the data of a flash memory. The flash memory generates a reproduction signal of the data of the flash memory based on the signal from the CPU, and the data of the flash memory is composed of an image expansion section and an encoder for outputting a video signal.

The memory apparatus further comprises inhibiting means for inhibiting the memory process to the flash memory in the memory processing section of the CPU by using the signal obtained by detecting a threshold value of the data in a sensor section for vehicle driving information at a calculation processing section of the CPU, and the input of a hold switch signal of the function switch. The function switch has a reset switch for releasing the inhibiting operation for inhibiting the memory process to the flash memory. The function switch is composed of a mode switch for the vehicle driving condition information, a mode switch for a traffic offense control memory, a reproduction switch for outputting the data stored in the flash memory as a video signal, a hold switch for inhibiting the memory process to the flash memory, and a reset switch for releasing the inhibiting operation for inhibiting the memory process to the flash memory.

The sensor section is composed of a collision sensor, a wheel speed sensor, a steering angle sensor, an acceleration sensor, a brake pressure sensor, a sound sensors and a vehicle interval sensor.

According to another broad aspect of the present invention, a memory apparatus for vehicle information data is provided, comprising: a memory processing section of a CPU for controlling a function switch for switching memory processing means of the vehicle's information data, a plurality of imaging devices for imaging an ambient drive state, a decoder for processing the image signals from the imaging means, an image compression section compressing the data of a luminance signal and a color signal from the decoder, a RAM for temporarily memorizing the signal of the image compressing section, a flash memory for permanently memorizing the signal from the RAM, and an encoder for converting the output signals from the image expansion section into a video signal to output the signal.

The CPU comprises a calculation processing section for introducing the output signals from a sensor section composed of a collision sensor, a wheel speed sensor, a steering angle sensor, an acceleration sensor, a brake pressure sensor, a sound sensor, and a vehicle interval sensor, and the memory processing section for introducing the output signals from a function switch composed of a mode switch for a drive condition memory, a mode switch for a traffic offense control memory, a reproduction switch, a hold switch, and a reset switch, and the output signals from the calculation processing section of the CPU.

BRIEF DESCRIPTION OF THE DRAWINGS

The present invention will become more clearly appreciated as the disclosure of the invention is made with reference to the accompanying drawings. In the drawings:

FIG. 10(*b*) shows a display example for displaying the face of a driver and the sensor data provided from a sensor section in the case where the CCD camera is located at the position 110; FIG. 10(*c*) shows a display example at which 3 seconds have lapsed since the display image in the above (a); FIG. 10(*d*) shows a display example after 3 seconds have lapsed from the display image in FIG. 10(*c*); and FIG. 10(*e*) shows a display example after 3 seconds have lapsed from the display image in FIG. 10(*d*).

DETAILED DESCRIPTION OF THE PREFERRED EMBODIMENTS

A memory apparatus for vehicle information data according to the preferred embodiments of the present invention will now be described in detail with reference to FIGS. 1 to 12 of the accompanying drawings.

Figure 1:
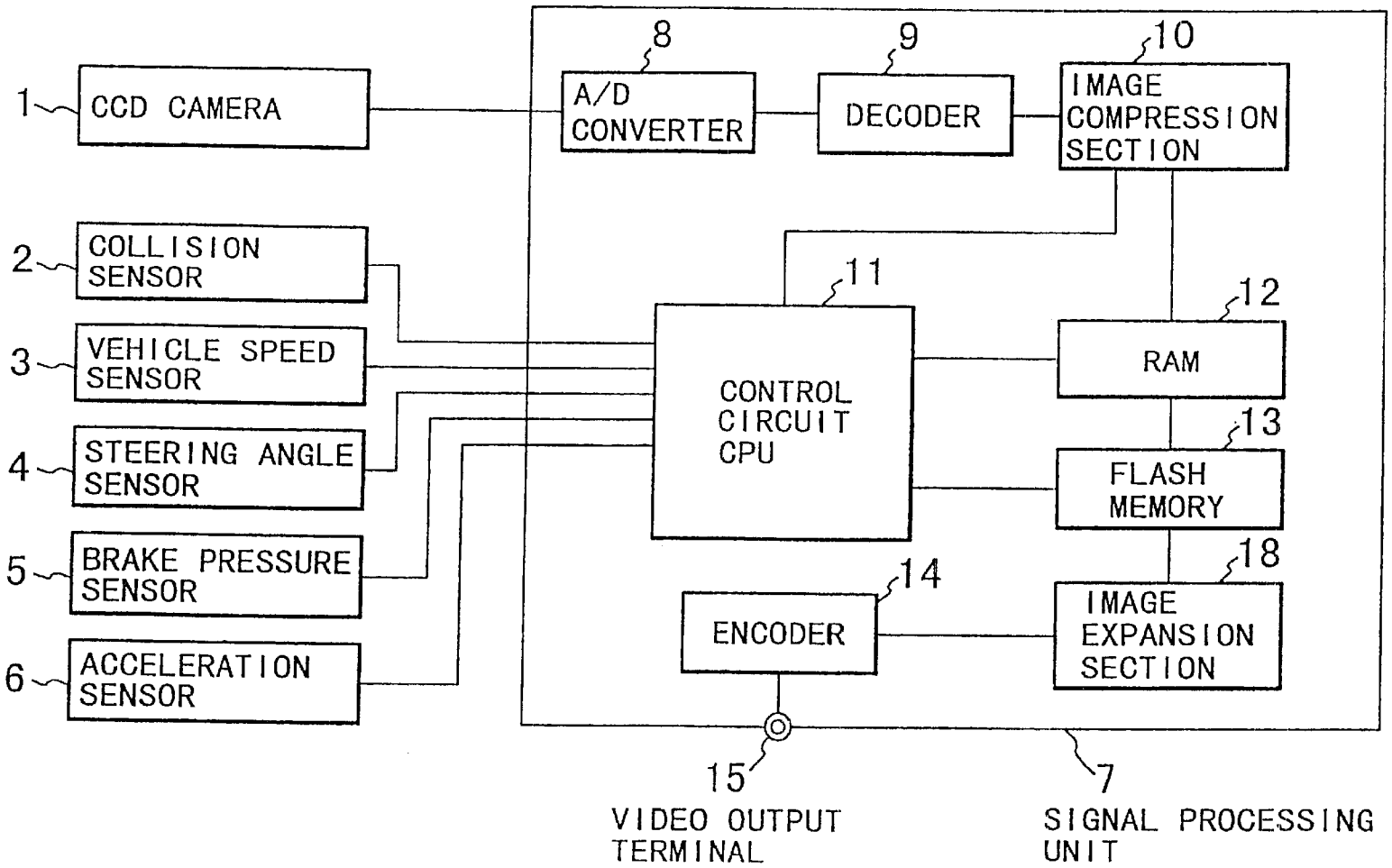
FIG. 1 is a view showing a block diagram according to a first embodiment of the present invention.

Referring now to FIG. 1, there is shown a block circuit according to a first embodiment of the memory apparatus for vehicle information data of the present invention. The memory apparatus includes a CCD camera 1, a collision sensor 2, a vehicle speed sensor 3, a steering angle sensor 4, a brake pressure sensor 5, an acceleration sensor 6, and a signal processing unit 7. The signal processing unit 7 is composed of an A/D converter 8, a decoder 9, an image compression section 10, a CPU (control circuit) 11, a RAM (Random Access Memory) 12, a flash memory 13, an image expansion section 18, an encoder 14, a video output terminal 15, and the like.

The CCD camera 1 takes an image representing the forward condition of a running vehicle. The video signal as image information is then converted through the A/D converter 8 in the signal processing unit 7 into a digital signal. The digital signal is then decoded by the decoder 9, compressed by the image compression section 10, and then memorized in the RAM 12.

The detected information from the sensors 2 to 6 is controlled by the CPU 11 and thereby recorded in the RAM 12 together with the compressed image information. The RAM 12 is composed of, for example, 16 sheets. The RAM 12 is controlled by the CPU 11 in such a manner that the oldest information is erased when the newest information is recorded, thereby performing endless recording for recording the newest information in the RAM 12. In this case, the timing for recording can be set voluntarily.

Figure 2:
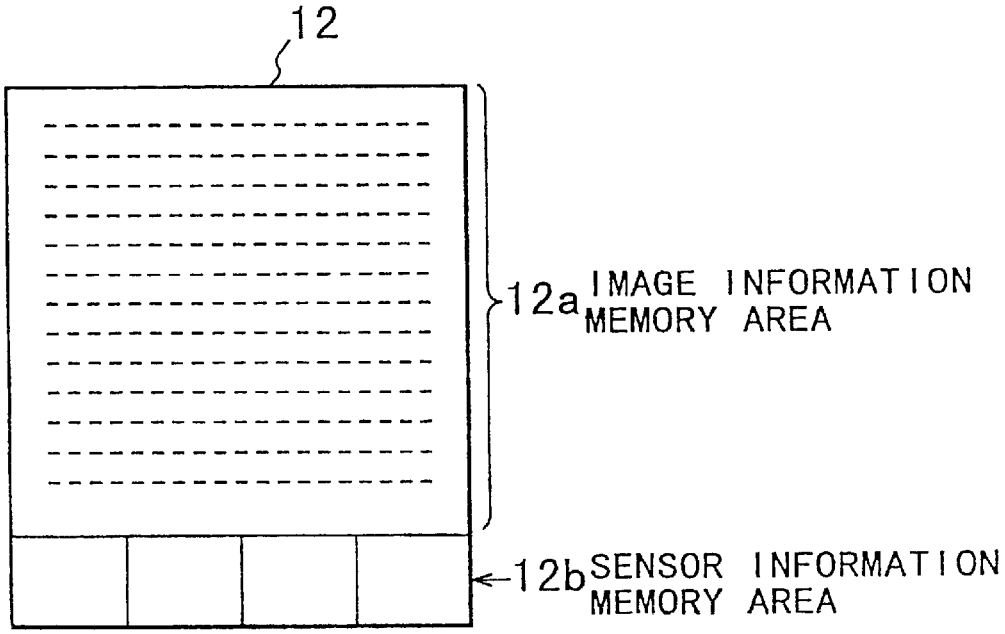
FIG. 2 is a view showing the structure of a memory area of the RAM (Random Access Memory) in the embodiment shown in FIG. 1.
Figure 3:
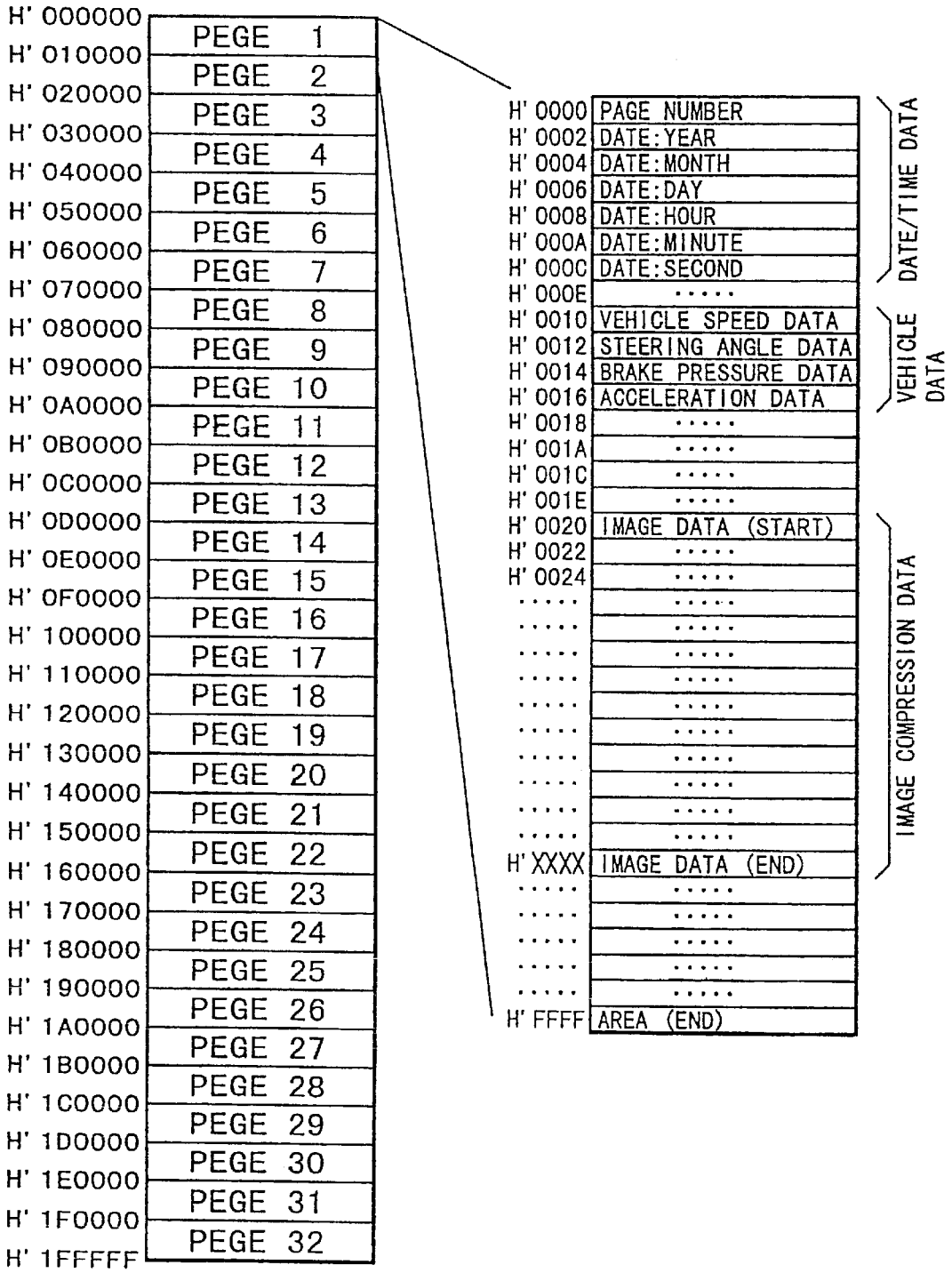
FIG. 3 is a view showing the structure of the information stored in the RAM of the embodiment shown in FIG. 1.

FIG. 2 shows a structure of the memory area of the RAM 12. The RAM 12 includes an image information memory area 12*a* and a sensor information memory area 12*b*. FIG. 3 shows the structure of the information to be recorded in the RAM 12. The information has the recording capacity of, for example, 1 to 32 pages. A date/time data, a vehicle data (sensor information), compression image data, and the like, are stored in each page.

When the collision sensor 2 is energized due to occurrence of a traffic accident, the CPU 11 outputs the order to inhibit the writing to the RAM 12, and the recording of the information is stopped. At that time, the newest information immediately before the stop is transferred from the RAM 12 to the flash memory 13, thereby avoiding deletion of the recorded information, even when the power source is disconnected upon the occurrence of the traffic accident.

Figure 4:
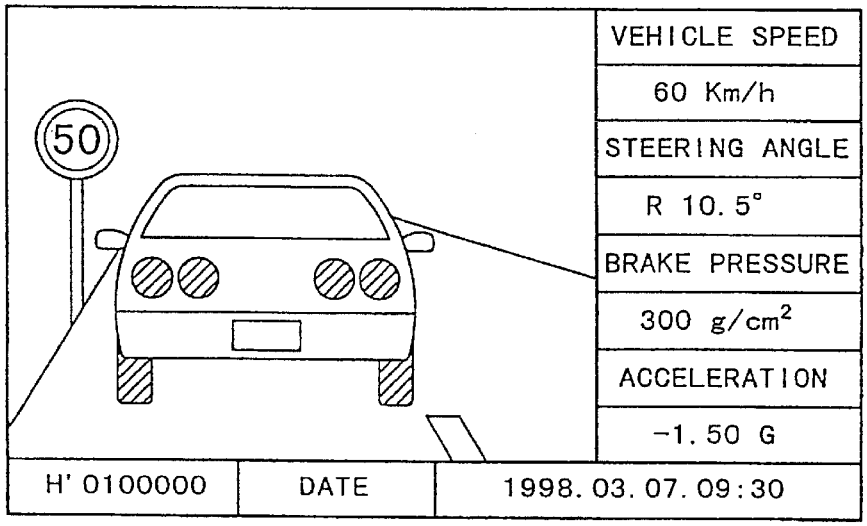
FIG. 4 is a view showing an example of the reproduced images in the embodiment shown in FIG. 1.

Upon analysis of the traffic accident, it is possible to process the information recorded in the flash memory 13 with a signal, such as the expansion of the compressed image information at the image expansion section 18. The image and sensor information immediately before the accident are then reproduced from the encoder 14 and obtained from the video output terminal 15. FIG. 4 shows an example of a reproduced image taken from the video output terminal 15.

Figure 5:
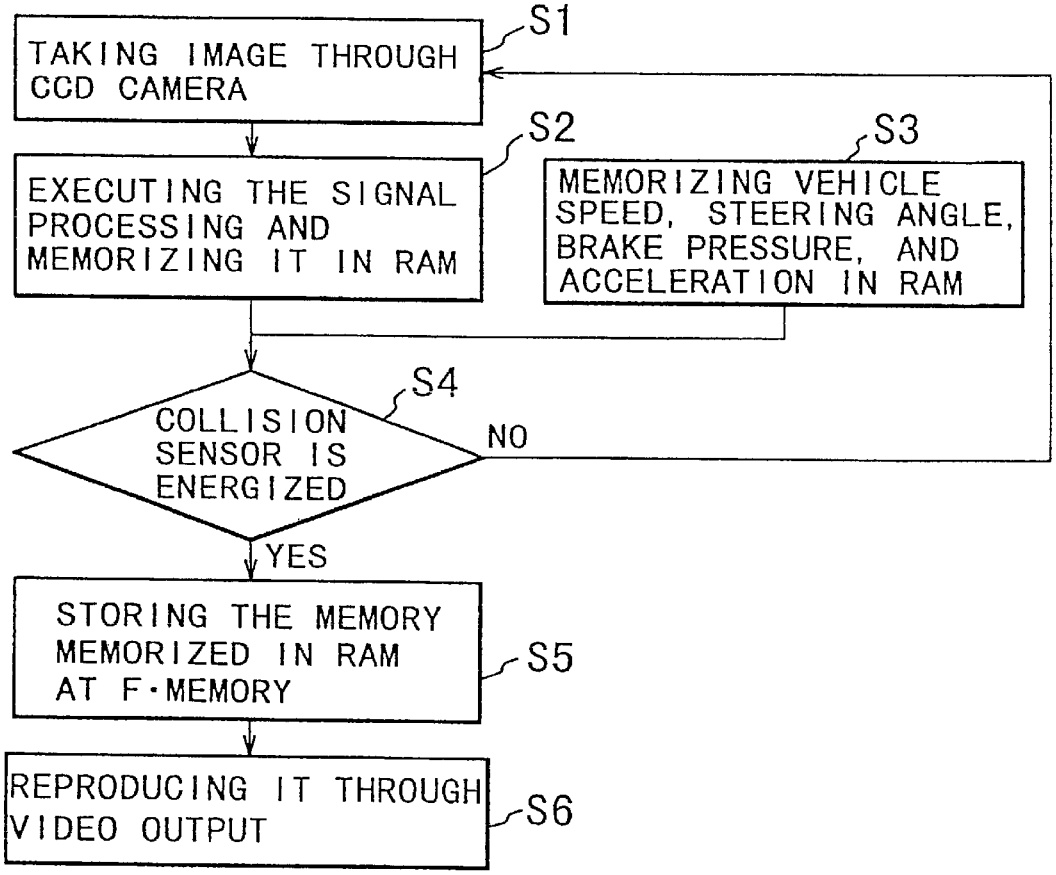
FIG. 5 is a flowchart showing the operation in the embodiment shown in FIG. 1.

FIG. 5 is a flowchart showing the operation of the present invention described above. In step S1 of FIG. 5, the image of the front side of a vehicle is taken by the CCD camera 1, then the image is recorded in the RAM 12 in step S2 after being processed with the signal mentioned above. The sensor information, such as the vehicle speed, the steering angle, the brake pressure, and the acceleration are recorded in the RAM 12 in step S3. In step S4, it is determined whether the collision sensor 2 is energized or not. If the collision sensor 2 is not energized (indicating no collision has occurred), the process is returned to the step S1. If the collision sensor 2 is energized (meaning a collision has occurred), the recorded information in the RAM 12 is transferred to and stored in the flash memory 13 in step S5. The image of the recorded information in the flash memory 13 is then reproduced in step S6.

Figure 6:
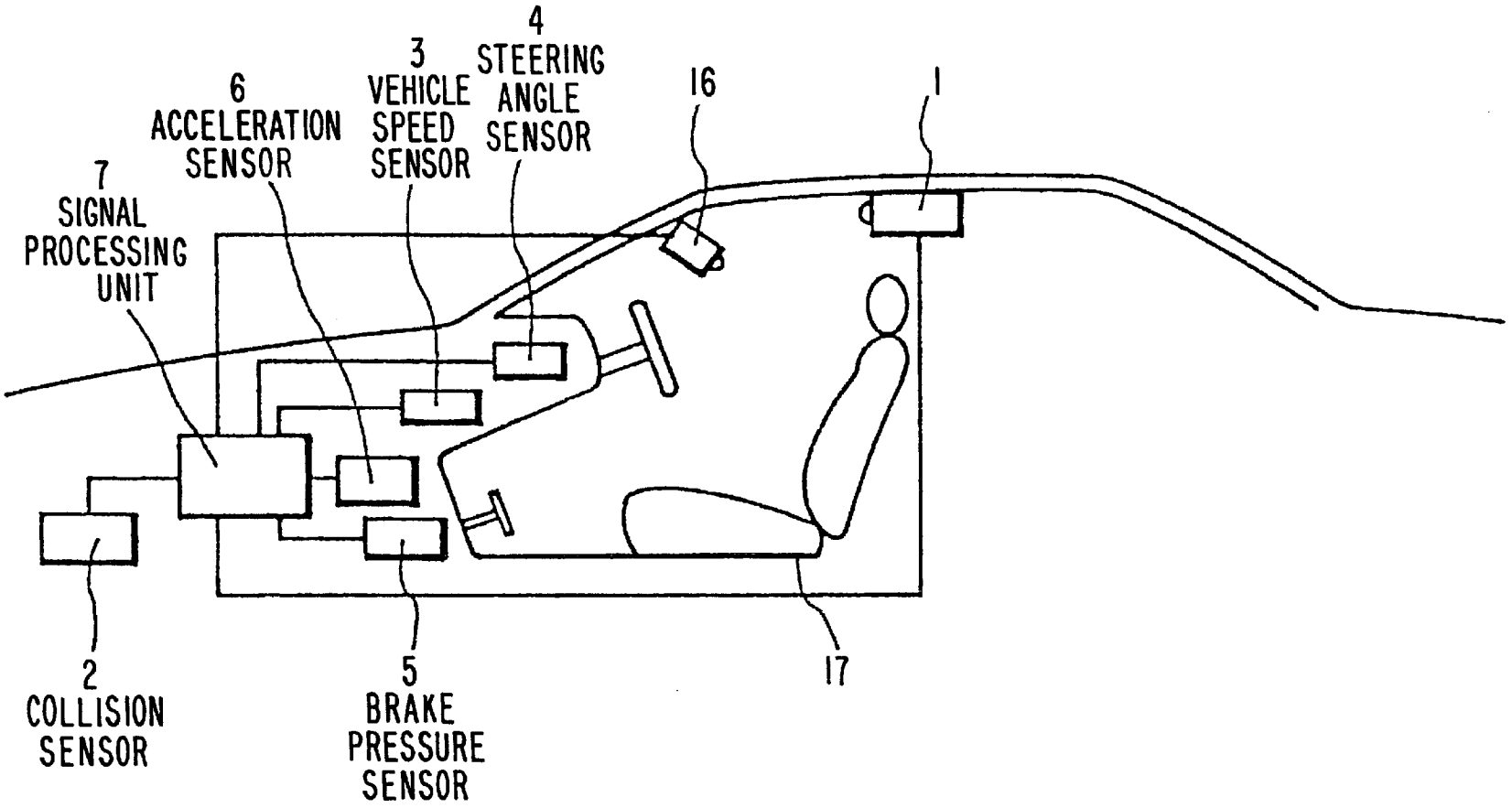
FIG. 6 is a view showing the arrangement of plural sensors and CCD cameras in the embodiment shown in FIG. 1.

FIG. 6 shows an arrangement of the sensors 2 to 6 and the CCD camera 1. In this example, the inside-vehicle camera 16 is specially mounted to record also the drive conditions of a driver at the drive's seat 17. By this, the driving conditions, such as a driver looking off or dozing at the wheel, can be detected.

The RAM 12 may be replaced with a video tape recorder. In this case, the flash memory 13 may be unnecessary.

Figure 7:
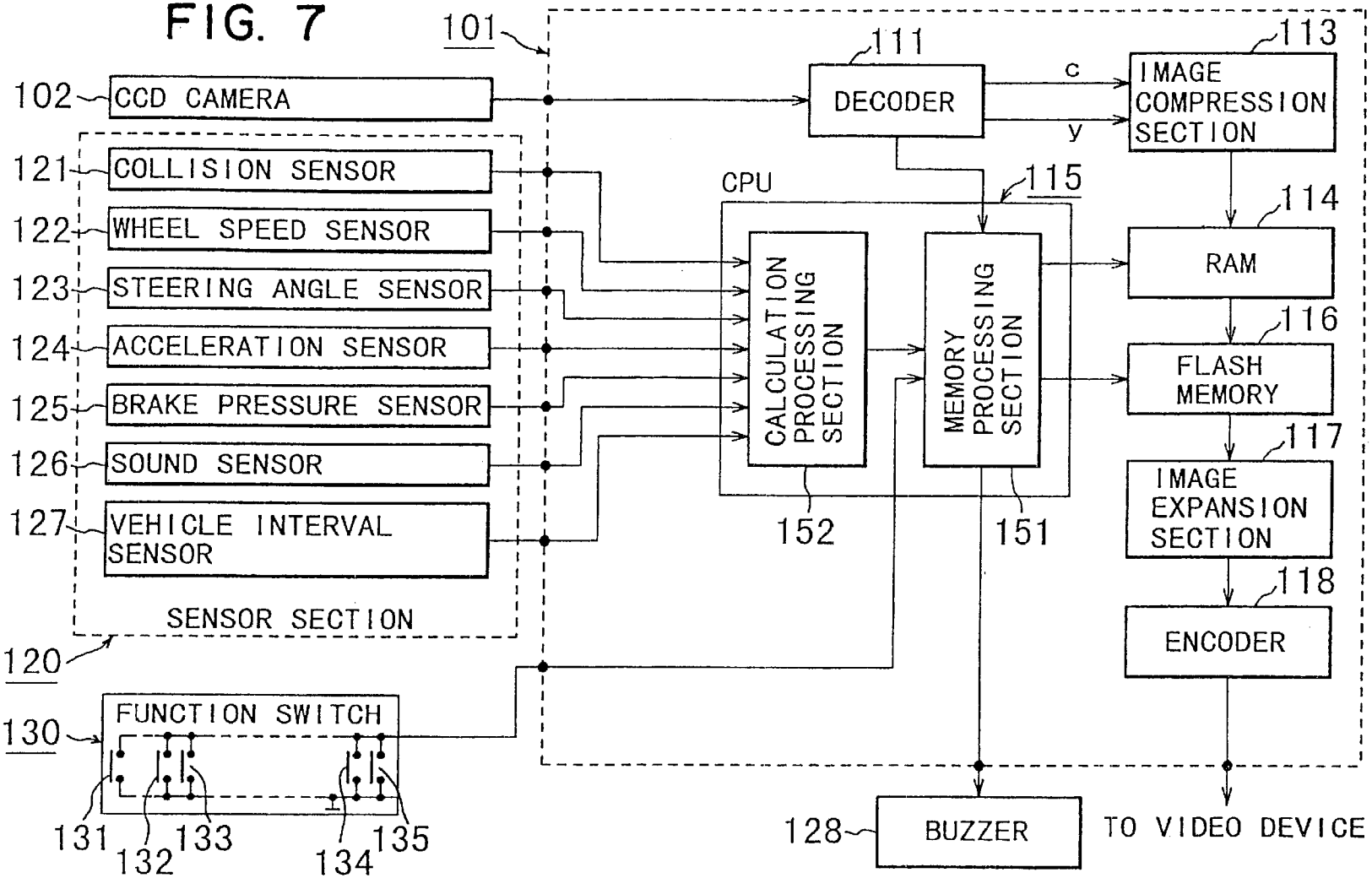
FIG. 7 is a view showing a block diagram according to a second embodiment of the present invention.

Next, FIG. 7 is a view showing an electrical circuit in block diagram form of a second embodiment of the present invention. As shown in FIG. 7, the circuit includes a signal processing unit 101 composed of a decoder 111, an image compression section 113, a RAM 114, a CPU 115, a flash memory 116, an image expansion section 117, and an encoder 118. The signal processing unit 101 is connected to a CCD camera 102 as an imaging device, a sensor section 120, a function switch 130, and a buzzer 128.

Figure 12:
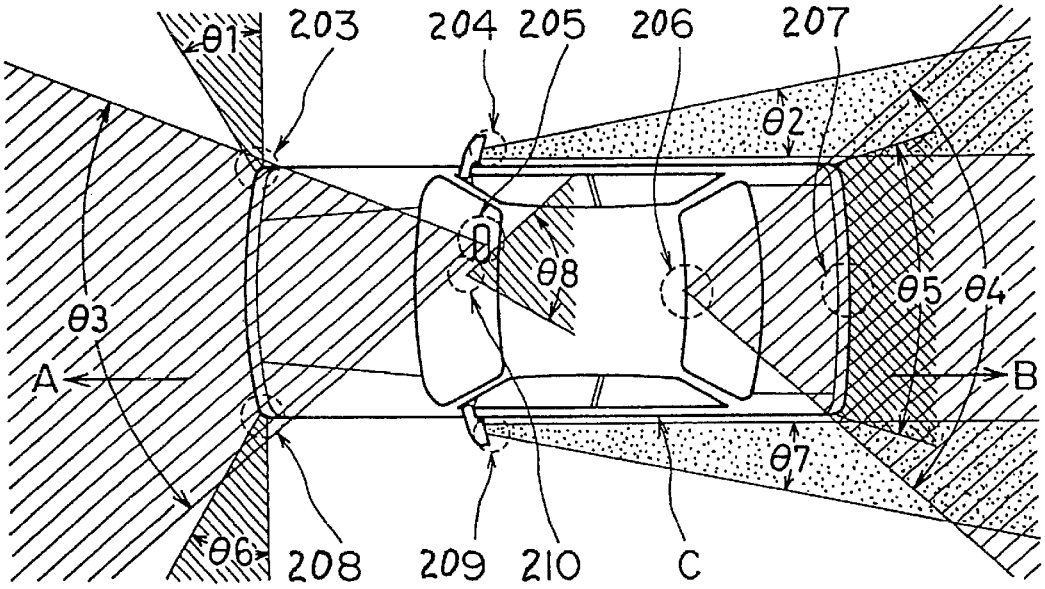
FIG. 12 is a schematic plan view showing an example of the vehicle in which the CCD camera shown in FIG. 7 is mounted at plural positions.

A plurality of CCD cameras 102 may be mounted in order to take the images of the ambient drive conditions, thereby outputting the images to the signal processing unit 101. The plural CCD cameras 102 may be disposed at suitable positions of the vehicle C, as shown in FIG. 12, where the arrows A and B denote the front side and the rear side of the vehicle C, respectively.

The image signals from an ambient condition that is difficult to see from a driver's seat of the vehicle C can be obtained by the CCD cameras disposed in the position 203 on the front side of the vehicle C with the view angle θ1 at the right side, and in the position 208 with the view angle θ6 at the left side, respectively.

The view angles θ2 and θ7 are obtained at the door mirror positions 204 and 209, respectively, to provide the image signals at the left and right rear conditions.

The view angle θ3 in the heading direction of the vehicle C (in the direction of arrow A) is obtained at the position 205, thereby providing the image signals representing the conditions that the preceding vehicle or the present vehicle C cross the white or yellow center line.

The view angle θ4 in the rear direction of the vehicle C (in the direction of arrow B) is obtained at the position 206, thereby providing the image signals representing the condition of the vehicle following the vehicle C.

The view angle θ5 is obtained at the position 207, thereby providing the image signals representing the obstacle's condition in the rear direction of the vehicle. The view angle θ8 in the vehicle is obtained at the position 210, thereby providing the image signals representing the driver's conditions, such as the driver taking his eyes off the road or dozing.

The sensor section 120 for outputting the signals on the basis of the vehicle drive information is composed of the collision sensor 121 for outputting signals upon the collision of the vehicle, the wheel speed sensor 122 for outputting the signal representing a slip condition of the vehicle, the steering angle sensor 123 for outputting the signal representing a dangerous abrupt operation of the steering wheel, the acceleration sensor 124 for outputting the signals representing an abrupt acceleration and deceleration, the brake pressure sensor 125 for outputting the signals representing a condition of the brake operation, the sound sensor 126 for outputting the signals representing a scream with high frequency band and a collision sound with low frequency band, and the vehicle interval sensor 127 for outputting the signals representing the condition immediately before a collision.

The function switch 130 for selecting the function of the memory device for the vehicle information data and inputting the operation conditions, is composed of a mode switch 131 used for memorizing the drive conditions, a mode switch 132 used for memorizing the control of traffic offenses, a reproduction switch 133 used for outputting the data memorized in the flash memory 116 to video devices, a hold switch 134 used for outputting the signals representing the positions N and P of an automatic transmission (referred to as AT hereinafter) for inhibiting the memorizing operation to the flash memory 116 and the signals for actuating a siren, and a reset switch 135 used for releasing the inhibiting operation for memorizing to the flash memory 116.

The buzzer 128 is operated by the CPU 115 through the output from the signal processing unit 101 to generate a warning sound with short duration for each of the memory operation and the releasing of the inhibiting operation for memorizing, thereby enabling the driver to recognize such operations.

The CPU 115 is composed of a calculation processing section 152 for making the signals from the sensor section 120 into data, and a memory processing section 151 for transmitting the signals from the calculation processing section 152 and the function switch 130 to the RAM 114 and the flash memory 116 on the basis of the timing from the decoder 111 to control the memory.

Figure 8:
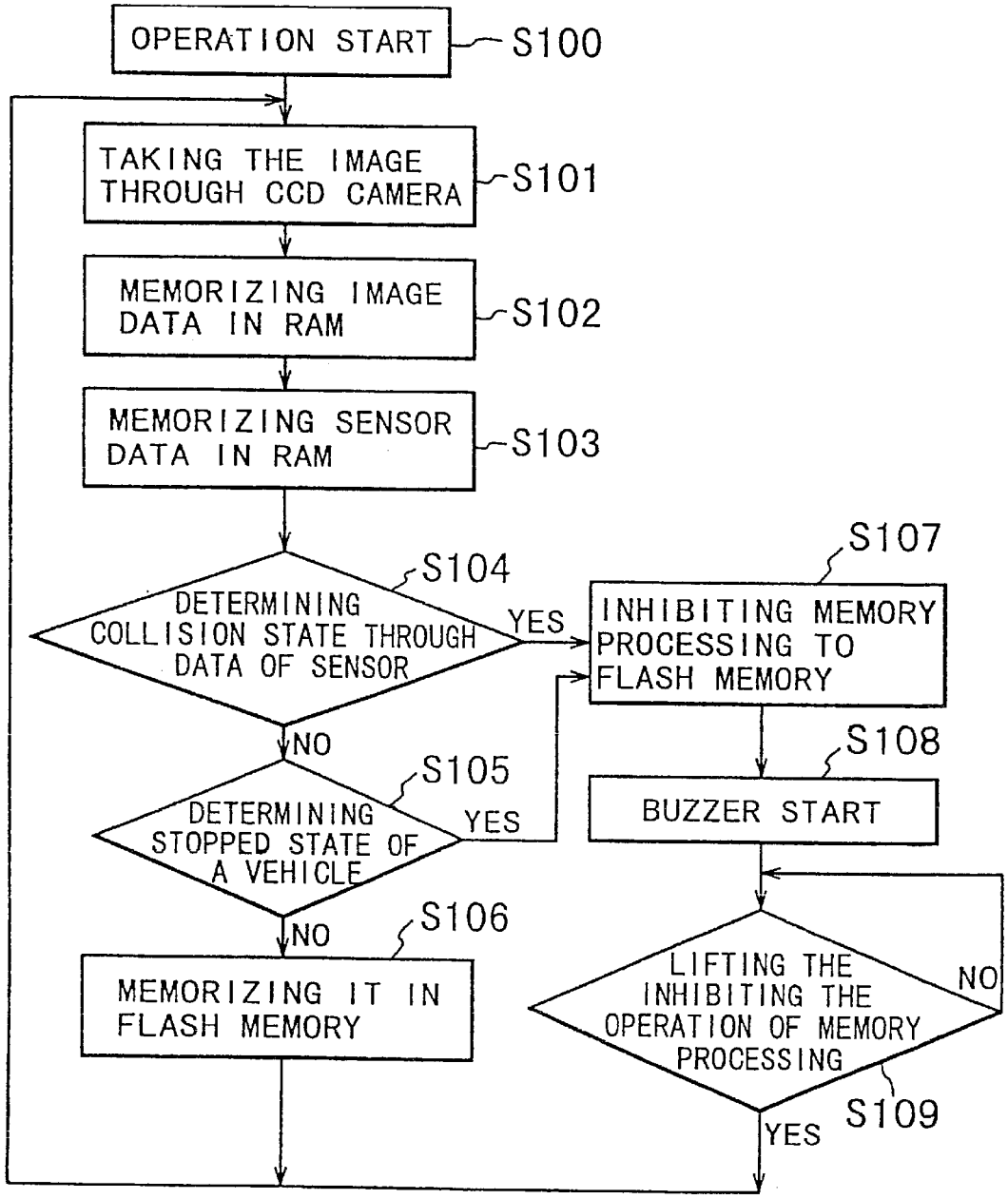
FIG. 8 is a flowchart showing the operation of the memory apparatus for vehicle information data in the case where the mode switch for memorizing a drive condition in the function switch, as shown in FIG. 7, is closed.

Referring now to FIGS. 7 and 8, there is described an example of the operation of the memory device of the present invention with the vehicle running. The operation will be described on the basis of the electrical circuit in FIG. 7 and the flowchart for memorizing the drive conditions in FIG. 8 as the vehicle collides with another vehicle and an air bag is actuated.

The flowchart in FIG. 8 shows the case where the mode switch 131 for memorizing the drive conditions in the function switch 130 is closed, the step S100 is in the state immediately before the traffic collision, and the following operation has already been effected. Namely, the signal processing unit 101 for vehicle information data is actuated upon the start of the vehicle's driving, and the image signals provided by the CCD camera 102 in the step S101 are separated into a color signal c and a luminance signal y by the decoder 111 and then compressed in the image compressing section 113.

In step S102, the compressed image data is stored in the RAM 114. In the next step S103, the signals on the basis of the vehicle drive information from the sensor section 120 are processed through the CPU 115 and stored as a sensor data in the RAM 114 along with the compressed image data.

Figure 11:
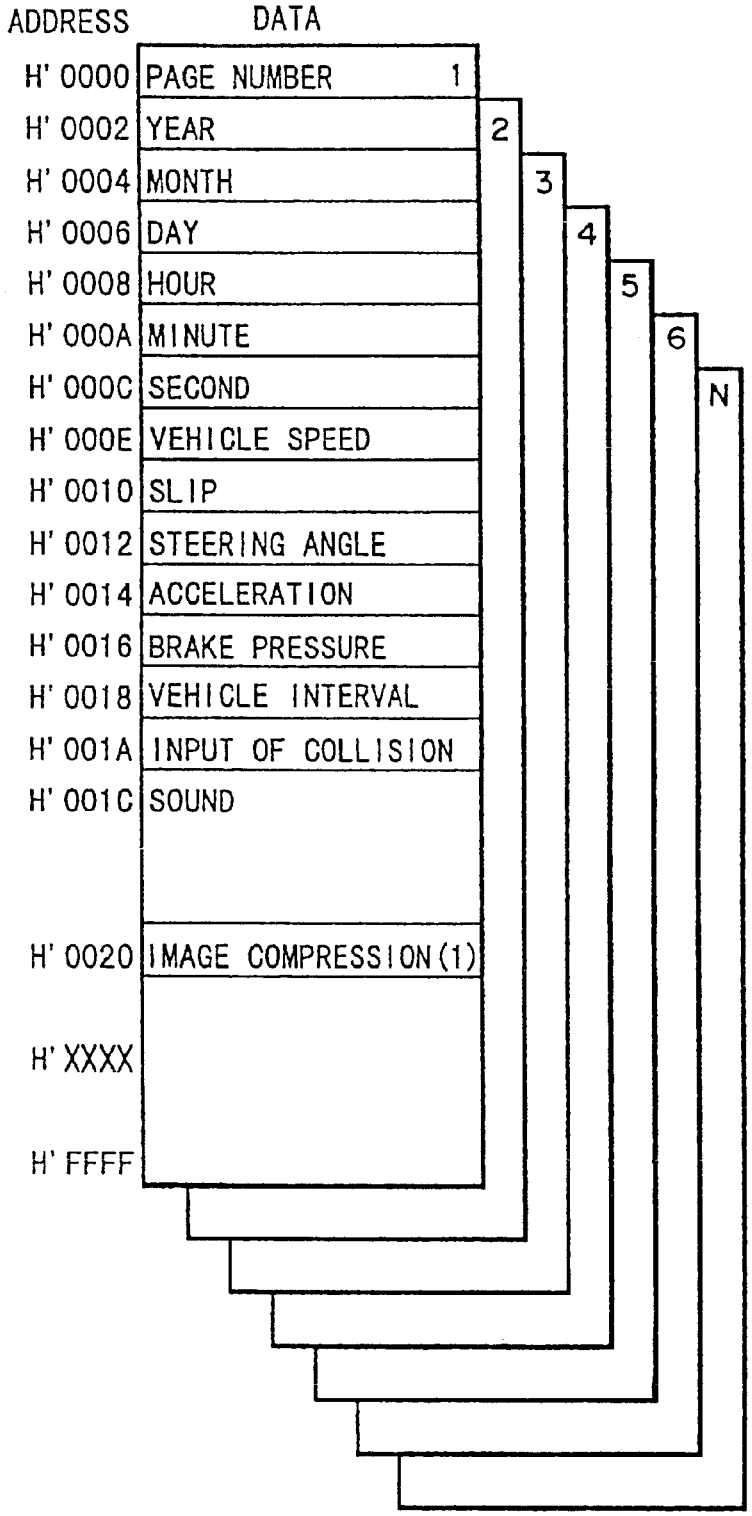
FIG. 11 is a view showing the data example of the data to be memorized in the RAM and the flash memory in the embodiment shown in FIG. 7.

As shown in FIG. 11, the data contents stored in the RAM 114 are renewed according to the electrical shutter timing of the CCD camera 102 together with the page number. Further, the page number is changed from the final page number to the head number to renew the memory contents under the address control of the CPU 115. Date, time, the image data, and the sensor data are stored in each page.

In step S104, an accident is recognized by comparing the signal from the sensor section 120 with the threshold value predetermined by the calculation processing section 152 of the CPU 115. For example, the calculation processing section 152 of the CPU 115 may recognize the threshold value representing a traffic accident based on the collision sensor 121 being actuated due to a traffic collision thereby actuating the air bag. If a threshold value representing an accident is recognized, the process is transferred to step S107. Otherwise, the process continues to step S105.

In step S105, the calculation processing section 152 recognizes, based on the signal from the wheel speed sensor 122, the condition that the vehicle is stopped, i.e., the speed sensor 122 detects a vehicle speed of 0 km/hr. A stopped condition can also be recognized, for example, by the AT lever corresponding to the hold switch 134 being positioned at P or N. If the stopped condition of the vehicle is recognized in the step S105, the process is then transferred to step S107. Otherwise, the process continues to step S106.

In the step S107, the memory processing section 151 of the CPU 115 inhibits the memorizing and transferring operation from the RAM 114 to the flash memory 116, thereby avoiding the additional memorizing operation to the memory which has been stored in the flash memory 116 and holding the past memory.

In step S108 following the step S107, the buzzer 128 is actuated for a short time, thereby advising the driver that the flash memory 116 has stored the memory.

In step S109, the process is advanced in the direction until the inhibiting operation for the memorizing process is released by the reset switch 135 of the function switch 130, thereby maintaining the memory of the flash memory 116. When the reset switch 135 is closed, the inhibiting operation for the memorizing process is released, thereby advancing the process in the direction and returning to the step S101 for an initial state.

As mentioned above, the drive condition upon occurrence of a traffic accident is maintained in the flash memory 116.

The step S104 may be omitted, and in that case the memorizing operation to the flash memory 116 is maintained from the occurrence of an accident to the vehicle's stop. In this case, the memory from the occurrence of an accident to the vehicle's stop is retained, thereby enabling an analysis of the vehicle's condition after occurrence of an accident.

The memory contents of the flash memory 116 are restored in non-compression data through the image expansion section 117 under the control of the memory processing section 151 of the CPU 115 by closing the reproduction switch 133 of the function switch 130. The video signal outputted from the encoder 118 may then be connected to the external video device, thereby recognizing the drive conditions, which helps analyze the accident.

The above example has been described for an accident in which the collision sensor 121 of the sensor section 120 is actuated. The calculation processing section 152 may recognize as an accident the case in which the signal representing the wheel's slip condition exceeds the threshold value implying the possibility of an accident on the basis of the signal from the wheel speed sensor 122. Further, the calculation processing section 152 may recognize an accident based on signals generated by the acceleration sensor 124, the sound sensor 126, and the vehicle interval sensor 127. For example, the acceleration sensor 124 can detect an accident based on the signal generated due to a dangerous abrupt steering operation, the signals representing the abrupt acceleration due to a rear-end collision, and the abrupt deceleration due to a dropdown into a recess in the road. The sound sensor 126 can detect an accident based on the signals representing a scream with high frequency band generated immediately before the accident and a sound with low frequency band generated upon the collision. The vehicle interval sensor 127 can detect an accident based on the signals representing the vehicle's condition immediately before the rear-end collision.

In the case where a normal drive is performed, except any vehicle accident mentioned above, the process is transferred to the step S105 in the direction NO under the assessment of the accident condition due to the data of the step S104. In the step 105 for assessment of the stop condition, it is recognized as a normal running, thereby the process is transferred to step S106 in the direction NO. In the step S106, the data stored in the RAM 114 in the steps S102 and S103 is transferred to the flash memory 116 to memorize the data, and then the process is returned to the step S101. As mentioned above, the processes in the steps S101, S102, S103, S104, S105, and S106 are usually repeated to renew the memory of the flash memory 116.

Figure 9:
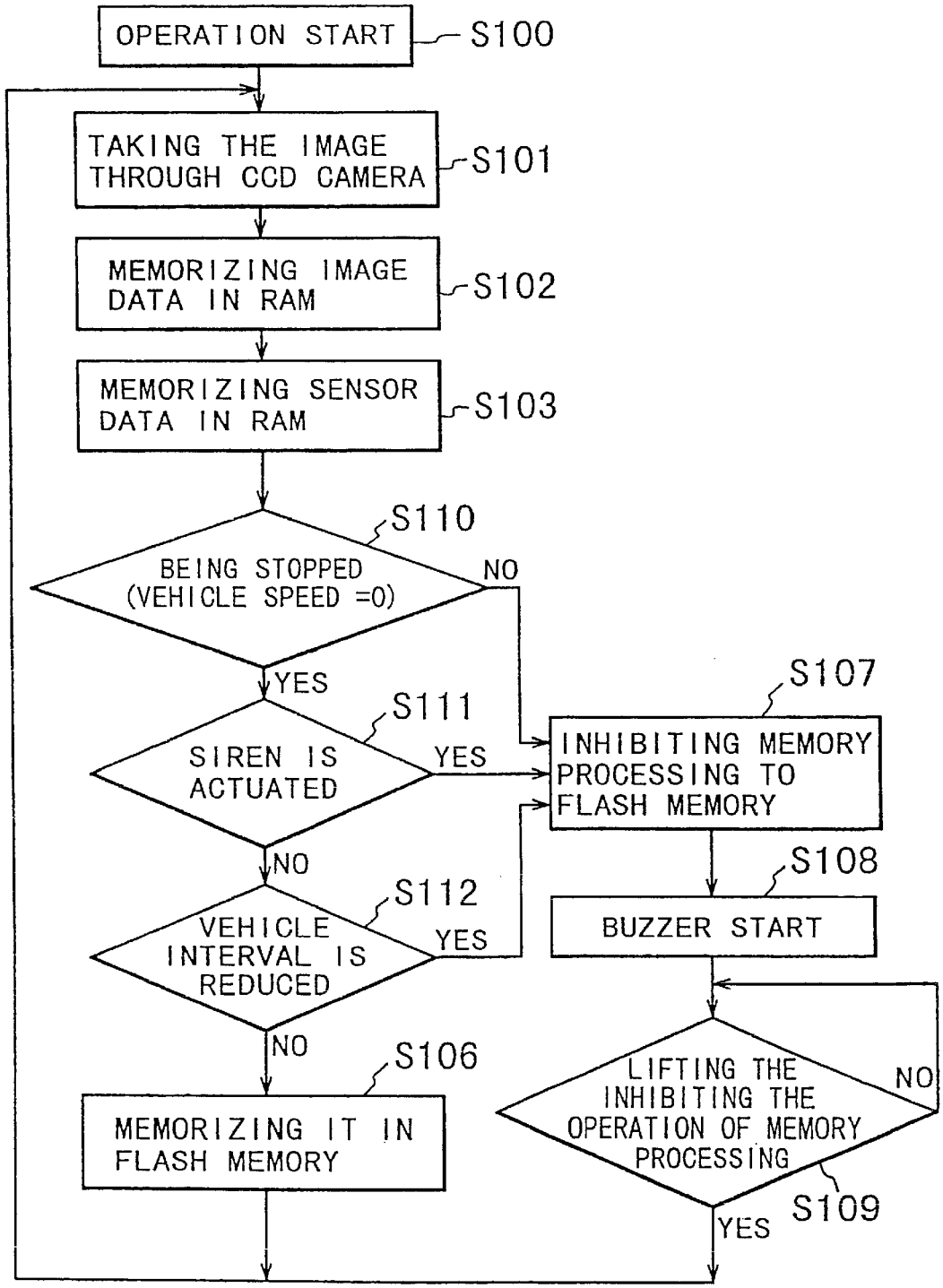
FIG. 9 is a flowchart showing the operation of the memory apparatus for vehicle information data in the case where the mode switch for memorizing a traffic offense control in the function switch, as shown in FIG. 7, is closed.
Figure 10A:
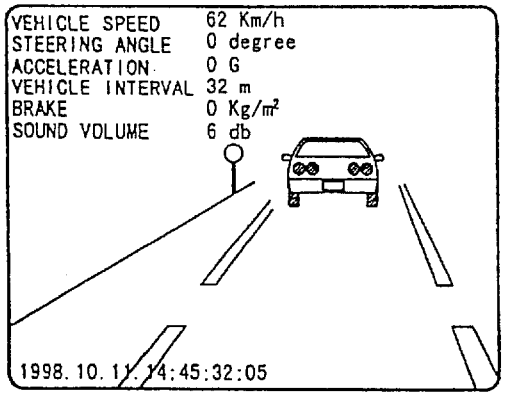
FIGS. 10(*a*) to 10(*e*) are views showing an example of the reproduced image of the operation memory in the memory device for the vehicle information data shown in FIG. 8, wherein FIG. 10(*a*) shows a display example for displaying the front side view and the sensor data provided from a sensor section in the case where the CCD camera is located at the position 105.
Figure 10B:
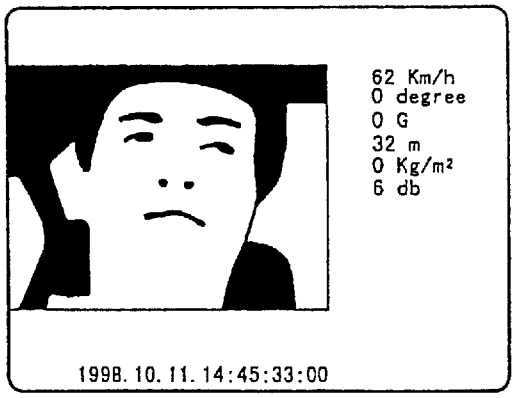
Figure 10C:
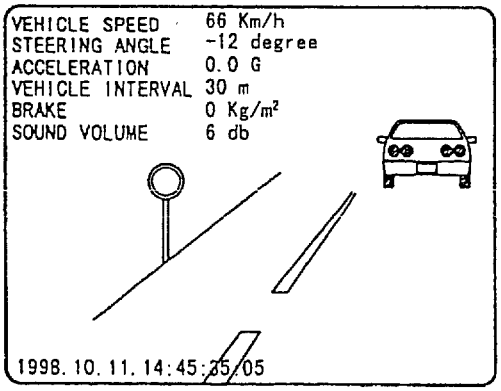
Figure 10D:
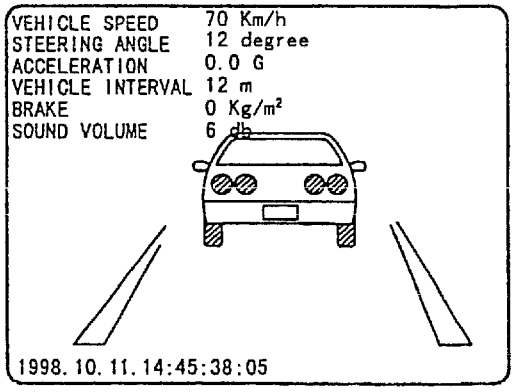
Figure 10E:
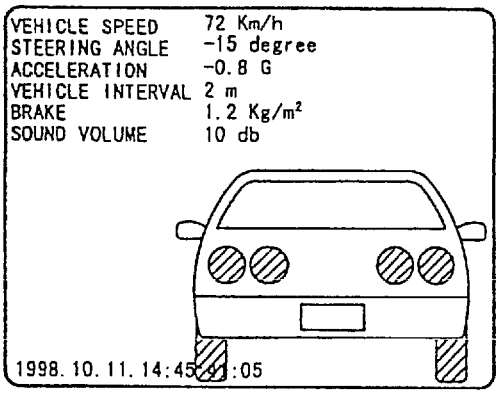

Referring now to the flowchart of FIG. 9, the embodiment for the control of a traffic offense will be described hereinafter. In the case where the mode switch 132 used for memorizing the control of the traffic offense in the function switch 130 is closed to set the mode of memory condition for the traffic offense control, the operation example for memorizing the drive condition according to the flowchart of FIG. 8 and the processes in the steps S100, S101, S102, S103, S106, S107, S108 and S109 are the same as the above, and therefore a further explanation thereof is omitted.

The operations in the steps S110, S111, and S112 in connection with the procedure of inhibiting the memorizing process to the flash memory in the step S107 will be described hereinafter.

In the step S110, if it is recognized that the vehicle is stopped through the signals from the hold switch 134 or the wheel speed sensor 122, the process is transferred to the step S111 in the direction YES. On the other hand, if the vehicle is running, the process is transferred to the step S107 in the direction NO, thereby performing the inhibiting operation for the flash memory process.

In the case where the vehicle C is in a traffic control, for example at a crossing where an emergency vehicle is stopped at a safe location within the crossing and the condition of the passing vehicles is supervised, the traffic condition is continuously memorized in the flash memory 116. On the other hand, in the case where an offending vehicle is detected and chased, the memory process to the flash memory is inhibited, thereby retaining the memory when the offending vehicle was detected.

In step S111, the actuation condition of an emergency siren is recognized. If the emergency siren is stopped, the process is transferred to step S112 in the direction NO. On the other hand, if the actuation of the siren is detected, the process is transferred to the step S107 in the direction YES to perform the inhibiting operation for the memory process of the flash memory.

In the case where, for example, an offending vehicle is detected through monitoring passing vehicles and the offending vehicle is chased sounding the siren, the memory process to the flash memory is inhibited, thereby retaining the memory when the offending vehicle was detected.

In the step S112, in the case where it is recognized that the vehicle interval is reduced on the basis of the threshold value of the vehicle interval sensor 127, the process is transferred to the step S107 in the direction YES to perform the inhibiting operation for the memory process of the flash memory. On the other hand, in the case where the vehicle interval is increased, the process is transferred to the step S106 in the direction NO to memorize the data in the flash memory 116.

In the case where, for example, an offending vehicle is detected through monitoring passing vehicles and the offending vehicle is chased and then approached, the memory upon approaching thereto is also retained in addition to the memory when the offending vehicle was detected. As mentioned above, it is possible to monitor and memorize the control of a traffic offense, thereby making it possible to preserve and produce evidence to prove the offense.

Referring now to FIG. 10, an example of images representing a doze at the wheel, as reproduced by a video device, will be described hereinafter.

By closing the reproduction switch 133 of the memory apparatus 101 for vehicle information data, the image data representing the ambient drive condition are stored in the flash memory 116, and the sensor data representing vehicle drive information are displayed on one image plane. FIG. 10(*a*) is a view showing the case where the vehicle stored on the page number 1 of the flash memory 116 is followed by another vehicle, and further a view showing the image of the front condition taken by the CCD camera 102 located at the position 105. FIG. 10(*b*) is a view showing the view of the dozing driver upon the following running, according to the CCD camera 102 located at the position 110, and the view of the driver is memorized on the page number 2. FIG. 10(*c*) is a view showing the image representing the front condition which is memorized on the page number 3, according to the CCD camera 102 located at the position 105. FIG. 10(*c*) shows the condition in which the steering angle of the sensor data is changed and the vehicle is moved toward the left side.

FIG. 10(*d*) is a view showing the image stored on the page number 4, in which the steering angle is operated in the opposite direction and the vehicle is running on a zigzag line and further the vehicle interval is shortened. FIG. 10(*e*) is a view showing the image stored on the page number 5, in which the preceding vehicle abruptly stops through abrupt braking, and the image shows the condition immediately before the rear-end collision. As mentioned above, it is possible to analyze the conditions of the preceding vehicle's drive and the present vehicle C's drive on the basis of the reproduced image.

As described above, the memory apparatus of the present invention makes it possible to memorize not only the image immediately before the occurrence of a predetermined condition, such as an accident, on the basis of the operation of the sensors for detecting a predetermined condition upon occurrence of any accident, but also the drive information from plural sensors simultaneously. Therefore, it is possible to clearly recognize the predetermined condition, thereby analyzing the cause of the accident smoothly.

The imaging means includes a camera in the vehicle, thereby enabling the record of the driver's conditions and the analysis of the cause clearly.

The record information storing means has a flash memory for inhibiting the information recording process of the recording means on the basis of the operation of the above-mentioned sensor, and further the newest record information is transferred to the flash memory. Therefore, the recorded information is not deleted even if the power is turned off after the occurrence of a predetermined condition, such as an accident, and an analysis of the accident can be performed using the recorded information to review the cause of the accident.

The above-mentioned record information storing means is structured so that the oldest information is deleted and the newest information is recorded. Therefore, it is possible to retain the information as a record which is the newest information from the current time to a predetermined passed time without a recording device with large capacity, thereby enabling an analysis of the cause of a traffic accident.

The memory apparatus is provided with an image compressing section for recording the image information under image compression and an encoder for processing the recorded information from the flash memory. Therefore, it is possible to enable the memory apparatus to be small in size and to be utilized in various fields, since it is not necessary to utilize a memory device with a large capacity.

The recording means includes a video recorder, which provides the memory apparatus with a simple structure, a high reliability, and a means of recording video images without interference from vibrations.

The above-mentioned sensor is a collision sensor. Therefore, it is possible to record the condition immediately before an accident and to provide a memory apparatus that is effective for analyzing the cause of the accident.

There are provided a function switch for switching memory processing means of vehicle's information data, a plurality of CCD cameras for imaging an ambient drive state, a RAM for memorizing the image signals from the CCD cameras, and a CPU for effecting a sequential memory processing of the signals on the basis of the vehicle drive information transmitted from the sensors to memorize them at the RAM and a flash memory. Therefore, the image data of the ambient drive and the sensor data can be stored simultaneously, and may be utilized for memorizing the drive condition and the traffic offense control by only switching the function switch.

The memory apparatus comprises a function switch for switching memory processing means of a vehicle's information data, and a CPU for feeding and controlling the data of a flash memory, wherein the flash memory generates a reproduction signal of the data of the flash memory on the basis of the signal from the CPU, and the data of the flash memory is composed of an image expansion section and an encoder for outputting a video signal. Therefore, it is possible to reproduce the image by using a video device as the means for outputting a video signal to analyze a vehicle's accident and the condition of a traffic offense in detail, thereby confirming a safe drive and producing effective evidence.

The memory apparatus further comprises inhibiting means for inhibiting the memory process to the flash memory in the memory processing section of the CPU by using the signal obtained by detecting a threshold value of the data in a sensor section for vehicle driving information at a calculation processing section of the CPU, and the input of a hold switch signal of the function switch. Therefore, the vehicle's condition in a traffic accident and a traffic offense and the important memory can be held reliably even with less memory capacity of the RAM and the flash memory, and useless data in the memory is less thereby reducing the time required for analysis of the accident.

The function switch has a reset switch for releasing the inhibiting operation for inhibiting the memory process to the flash memory. Therefore, the memory operation is effected repeatedly, thereby enabling the memory apparatus to memorize traffic conditions that do not develop to any accident, and further making the memory an economical insurance for a traffic condition that cannot otherwise be reproduced.

The function switch is composed of a mode switch for the vehicle driving condition information, a mode switch for a traffic offense control memory, a reproduction switch for outputting the data stored in the flash memory as a video signal, a hold switch for inhibiting the memory process to the flash memory, and a reset switch for releasing the inhibiting operation for inhibiting the memory process to the flash memory. Therefore, it is possible to select the switch of the operation mode, the reproduction of the image, the inhibition of the memory process, and the release of the inhibition, thereby effectively utilizing the memory apparatus for vehicle information data in accordance with the purpose of usage.

The sensor section is composed of a collision sensor, a wheel speed sensor, a steering angle sensor, an acceleration sensor, a brake pressure sensor, a sound sensor, and a vehicle interval sensor. Therefore, it is possible to memorize the vehicle drive information in a multi-mode, thereby enabling a precise analysis of an accident.

According to another feature of the present invention, a memory apparatus for vehicle information data is composed of a memory processing section of a CPU for controlling a function switch for switching memory processing means of a vehicle's information data, a plurality of CCD cameras for imaging an ambient drive state, a decoder for processing the image signals from the CCD cameras, an image compression section for compressing the data of a luminance signal and a color signal from the decoder, a RAM for temporarily memorizing the signal of the image compressing section, a flash memory for permanently memorizing the signal from the RAM, and an encoder for converting the output signals from the image expansion section into a video signal to output the signal. The CPU is composed of a calculation processing section for introducing the output signals from a sensor section and for outputting the signals on the basis of the vehicle drive information. The sensor section is composed of a collision sensor, a wheel speed sensor, a steering angle sensor, an acceleration sensor, a brake pressure sensor, a sound sensor, and a vehicle interval sensor. The memory processing section for introducing the output signals from a function switch is composed of a mode switch for a drive condition memory, a mode switch for a traffic offense control memory, a reproduction switch, a hold switch, and a reset switch, and the output signals from the calculation processing section. Therefore, the image data of the instance of a traffic accident and a traffic offense, the important drive ambient condition from the occurrence of the accident to the vehicle's stop, and the sensor data can be memorized in the flash memory repeatedly and a precise analysis of the accident can be performed upon the reproduction, thereby enabling the confirmation of a safe drive and producing effective evidence. Moreover, the amount of useless memory is less, thereby economically reducing the time required for analysis of the accident.

It will be appreciated that the present invention is not limited to the exact construction that has been described above and illustrated in the accompanying drawings, and that various modifications and changes can be made without departing from the scope and spirit thereof. It is intended that the scope of the invention only be limited by the appended claims.

What is claimed is:

1. A memory apparatus for vehicle information data, comprising:

imaging means for imaging a vehicle's condition during a running state;

drive information sensing means for sensing, during the running state, at least one of a vehicle's speed, a steering angle, a brake pressure, and an acceleration;

recording means for recording image information from said imaging means and drive information from said drive information sensing means simultaneously;

at least one sensor for detecting a predetermined condition after a vehicle's accident; and memory inhibiting means for inhibiting further information recording by said recording means upon the predetermined condition being detected by said sensor.

2. The memory apparatus for vehicle information data according to claim 1, wherein said imaging means includes a camera in the vehicle for imaging a drive condition of an inside of the vehicle.

3. The memory apparatus for vehicle information data according to claim 2, further comprising a record information storing means for storing recorded information from said recording means, said record information storing means has a flash memory and transfers the newest recorded information to said flash memory.

4. The memory apparatus for vehicle information data according to claim 3, wherein said recording means deletes the oldest information and records the newest information.

5. The memory apparatus for vehicle information data according to claim 4, further comprising an image compression section for compressing said image information to record, and an encoder for processing said record information from said flash memory.

6. The memory apparatus for vehicle information data according to claim 1, wherein said recording means includes a video recorder.

7. The memory apparatus for vehicle information data according to claim 1, wherein said sensor is a collision sensor for detecting an occurrence of a traffic accident.

8. The memory apparatus for vehicle information data according to claim 1, wherein said drive information sensing means comprises a vehicle speed sensor, a steering angle sensor, a brake pressure sensor, and an acceleration sensor.

9. The memory apparatus for vehicle information data according to claim 1, further comprising a record information storing means for storing recorded information from said recording means, said record information storing means has a flash memory and transfers the newest recorded information to said flash memory.

10. The memory apparatus for vehicle information data according to claim 9, further comprising an image compression section for compressing said image information to record, and an encoder for processing said record information from said flash memory.

11. The memory apparatus for vehicle information data according to claim 1, wherein said recording means deletes the oldest information and records the newest information.

12. The memory apparatus for vehicle information data according to claim 1, wherein said predetermined condition is a stopped state of a vehicle.

13. The memory apparatus for vehicle information data according to claim 12, wherein said sensor is a wheel speed sensor that detects said stopped state.

14. The memory apparatus for vehicle information data according to claim 1, further comprising a record information storing means for storing recorded information from said recording means into a flash memory.

15. The memory apparatus for vehicle information data according to claim 14, wherein said record information storing means stores recorded information from said recording means into a flash memory from the time of a vehicle's accident until the vehicle is in a stopped state after the accident.

* * * * *